US008104217B2

(12) United States Patent
Huber

(10) Patent No.: US 8,104,217 B2
(45) Date of Patent: Jan. 31, 2012

(54) RIFLESCOPE HIGH SPEED ADJUSTING ELEVATION ASSEMBLY

(75) Inventor: Jeff Huber, Orofino, ID (US)

(73) Assignee: Lightforce USA, Inc., Orofino, ID (US)

( * ) Notice: Subject to any disclaimer, the term of this patent is extended or adjusted under 35 U.S.C. 154(b) by 408 days.

(21) Appl. No.: 12/363,658

(22) Filed: Jan. 30, 2009

(65) Prior Publication Data

US 2009/0199452 A1 Aug. 13, 2009

Related U.S. Application Data

(60) Provisional application No. 61/063,265, filed on Jan. 31, 2008, provisional application No. 61/144,400, filed on Jan. 13, 2009.

(51) Int. Cl.
*F41G 1/38* (2006.01)

(52) U.S. Cl. ..... 42/125; 42/119; 42/120; 42/122; 359/405; 359/410

(58) Field of Classification Search ..... 42/119, 42/120, 122, 125; 359/405, 410, 428, 429
See application file for complete search history.

(56) References Cited

U.S. PATENT DOCUMENTS

| | | | | |
|---|---|---|---|---|
| 1,288,977 | A * | 12/1918 | Palmer | 42/126 |
| 3,826,012 | A * | 7/1974 | Pachmayr | 42/122 |
| 4,247,161 | A * | 1/1981 | Unertl, Jr. | 359/424 |
| 6,705,037 | B2 * | 3/2004 | Van Kirk | 42/126 |
| 7,272,904 | B2 * | 9/2007 | Larue | 42/127 |
| 7,411,750 | B2 * | 8/2008 | Pai | 359/822 |
| 7,626,760 | B2 * | 12/2009 | Wu | 359/426 |
| 7,757,423 | B1 * | 7/2010 | Swan | 42/127 |
| 2003/0140545 | A1 * | 7/2003 | Huber | 42/122 |
| 2004/0144013 | A1 * | 7/2004 | Leatherwood | 42/126 |
| 2007/0137089 | A1 * | 6/2007 | William et al. | 42/122 |

FOREIGN PATENT DOCUMENTS

GB 1253435 * 11/1970

* cited by examiner

*Primary Examiner* — Bret Hayes
*Assistant Examiner* — Joshua Freeman
(74) *Attorney, Agent, or Firm* — Wood, Herron & Evans, LLP

(57) ABSTRACT

A riflescope high speed, coarse and fine adjustment assembly that includes a riflescope with an erector tube located inside a scope body. Formed on the scope body is a mounting surface with a lead screw slot located adjacent to the proximal end of the erector tube. Located over the mounting surface is an adjustment plate with a perpendicularly aligned post member located thereon. Located inside the post member is a threaded lead screw with threaded head that connects to the post member and a lower non-threaded neck that extends into a slot formed on the mounting surface. The adjustment plate is affixed along its front edge while the plate's opposite rear section is detached and free to move up or down. Disposed over the adjustment plate is a cover plate with a fine adjustment lever that selectively rises and lowers the rear edge of the cover plate. Attached to the cover plate is a detent plate. Attached over the detent plate is a coarse adjustment dial. During use, the coarse adjustment dial is rotated for the target distance and then the fine adjustment lever is rotated which causes the adjustment plate to finely adjust the length of the lead screw.

17 Claims, 9 Drawing Sheets

RIFLESCOPE HIGH SPEED ADJUSTING ELEVATION ASSEMBLY

This is a utility patent application which claims benefit of U.S. Provisional Application No.'s 61/063,265 filed on Jan. 31, 2008 and 61/144,400 filed on Jan. 13, 2009.

BACKGROUND OF THE INVENTION

1. Field of the Invention

This invention pertains to riflescopes and more particularly to riflescopes with elevation adjustment knobs.

2. Description of the Related Art

Riflescopes typically include elevation adjustments that enable the shooter to shoot accurately at different target distances by turning the elevation adjustment mounted on the top of the riflescope. When the elevation adjustment is rotated, the riflescope's elevation changes from the scopes zero point. Conventional elevation adjustments on a riflescope have preset 'click' values which determine the amount of elevation change when the adjustment is rotated one click or to a predetermined mark on the adjustment. Most elevation adjustment knobs have a click value of ¼, ½, 1 MOA or milrad or some other measurement unit.

The smaller the click value, the greater number of rotations must be made to the elevation adjustment to adjust to different target distances. This can create a slow and confusing situation for the shooter because the dial position must be counted and does not reflect the actual scope adjustment setting, thereby slowing engagement time with the target. If the elevation adjustment has relatively small MOA click values, the total amount of elevation movement per rotation of the adjustment, is limited. When the riflescope has a relatively large click value, the amount of elevation change in one rotation is greater thereby enabling the shooter to quickly adjust the scope for different distances. Unfortunately, riflescopes with relatively large click values can't be finely adjusted at greater distances thus reducing accuracy.

What is needed is a riflescope with a high speed elevation adjustment assembly that allows fast coarse adjustment allowing the shooter to quickly adjust the riflescope for shooting at different distances and also allows the shooter to finely adjust the riflescope for shooting targets at longer distances with maximum accuracy. Having two elevation adjustments, one coarse and one fine, allows for maximum speed without sacrificing accuracy and allows the shooter to return to the zero setting easier than conventional adjustments, even by feel, without visual confirmation of the settings.

SUMMARY OF THE INVENTION

These and other objects of the invention are met by the riflescope high speed, coarse and fine adjustment assembly disclosed herein that includes a riflescope with an elongated body that houses an erector tube. Formed on the top surface of the scope body and adjacent to the proximal end of the erector tube is a mounting surface. Formed on the mounting surface is a slotted bore designed to receive the smooth, lower neck of a lead screw that moves up and down through the slotted bore to raise or lower the proximal end of the erector tube.

Disposed over the mounting surface is an adjustment plate with a perpendicularly aligned post member formed thereon. The post member includes a threaded bore designed to connect to the upper threaded neck of the lead screw. In the first embodiment, the adjustment plate is a flex plate affixed along its front edge to the mounting surface. The flex plate includes a flat plate with a transversely aligned groove formed on its lower surface. The groove enables the rear section of the flex plate to bend upward or downward when an upward or downward force is exerted on the rear section of the flex plate. The flex plate is slightly beveled so that when the front section of the flex plate is attached to the mounting surface, the rear section is slightly elevated above the mounting surface. One or more optional springs are disposed between the rear section of the flex plate and the mounting surface to bias the rear section upward.

In a second embodiment, the adjustable plate is a hinge plate pivotally attached to the front edge of a cover plate stacked above the hinge plate. The hinge plate has a flat, thick front section and a rear section with a beveled lower surface. One or more optional springs are disposed between the rear section of the hinge plate and the mounting surface to apply upward pressure to the rear section of the hinge plate.

The lead screw neck is sufficient in overall length to press against the proximal end of the erector tube located inside the scope body when extended through the slotted bore and to extend into the post member. During assembly, the external threads on the upper head of the lead screw are attached to the internal threads inside the post member. When the post member is rotated, the lower end of the lead screw advances or retracts through the slotted bore formed in the mounting surface.

Attached to the top surface of the cover plate is an O-ring seal assembly with a center bore designed to slidingly receive the upper end of the post member. Attached to the rear section of the cover plate is a fine adjustment lever. In one embodiment, the fine adjustment lever is attached to a threaded post that when rotated, extends and presses against a receiving surface formed on the top surface of the adjustable plate. In a second embodiment, the fine adjustment lever is attached to a cylindrical member that extends downward from the adjustment plate. The cylindrical member includes a stepped cam face that contacts a cam follower ball located on the rear section of the adjustment plate.

In both embodiments, the fine adjustment lever is selectively rotated to raise or lower the rear section of the adjustment plate with respect to the cover plate. As the rear edge is moved, a force is exerted on the post member that causes the post member to move to an axially offset position.

Attached to the O-ring seal assembly on the cover plate is a circular detent plate with at least one laterally extending tooth. Attached over the detent plate is a course adjustment dial which includes vertically aligned splines formed on the inside surface that are engaged by the tooth on the detent plate. During operation, the tooth on the detent plate engages the splines on the dial to produce the classic. 'clicking sound' commonly heard on riflescopes. In the preferred embodiment, the splines are sufficient in quantity and spaced apart so that one rotation of the coarse dial allows 2 degrees or 120 minutes of travel.

Mounted on the side of the coarse adjustment dial and the windage dial are optional stop tabs that are engaged by a release arm mounted on the cover plate. During use, the tabs and release arm are used to create a zero point for the riflescope. When pressed, the release arm disengages from the stop tabs and allows the coarse elevation dial and the windage dial to rotate freely in either direction beyond the pre-defined zero point. When the coarse elevation dial or the windage dial are rotated back to their original location, the release arm re-engages the stop tabs automatically resetting the original zero point, locking both elevation and windage turrets, thus preventing accidental change to the shooters original zero point.

DESCRIPTION OF THE PREFERRED EMBODIMENT(S)

Figure 1:
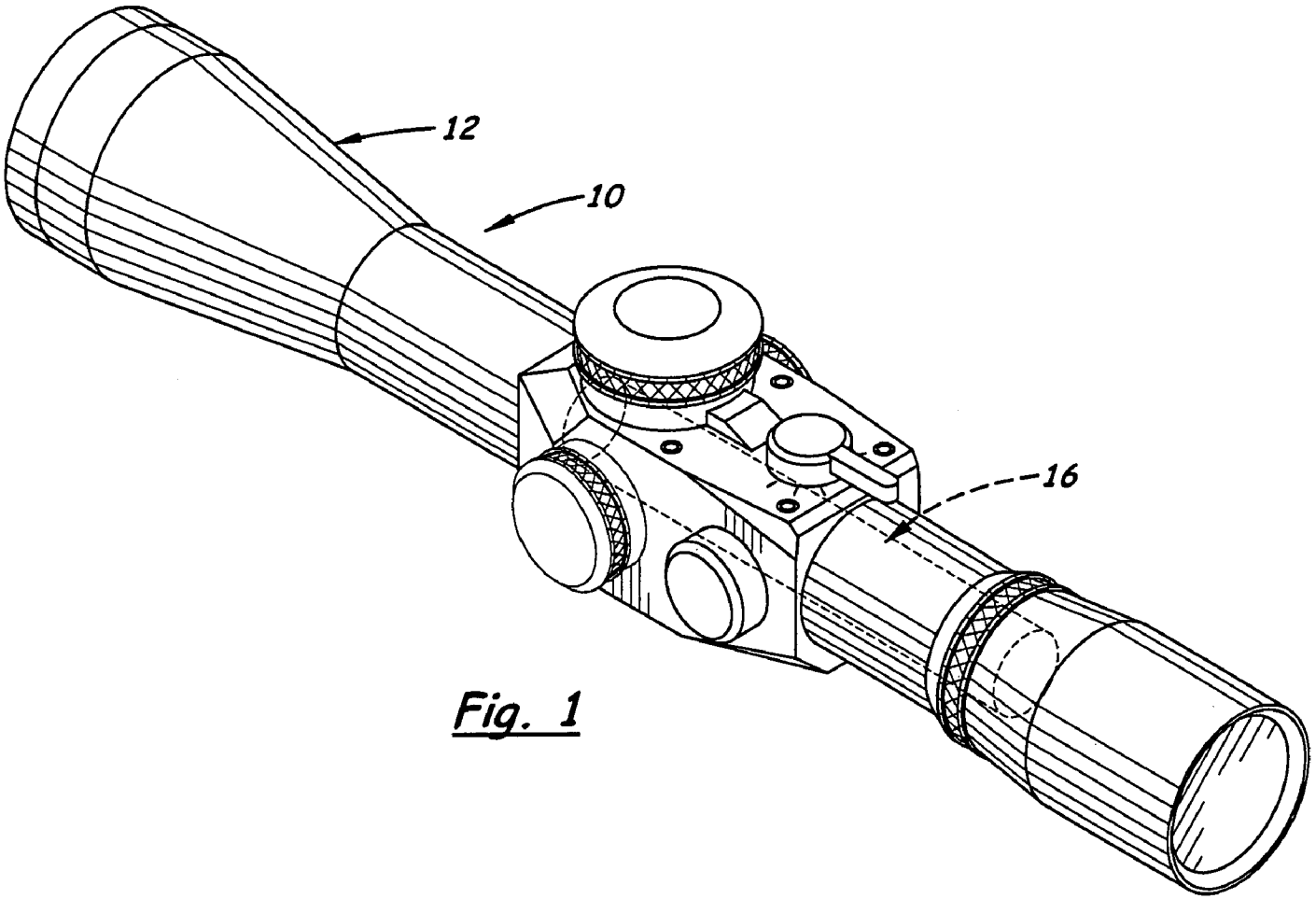
FIG. 1 is a perspective view of a riflescope with the high speed, adjustable elevation assembly mounted thereon.
Figure 2:
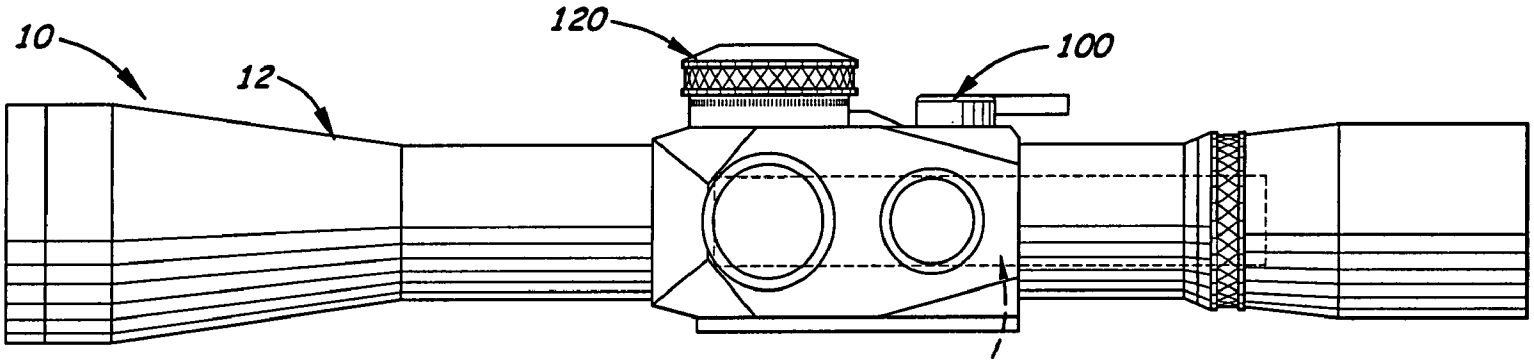
FIG. 2 is a side elevational view of the riflescope shown in FIG. 1.
Figure 3:
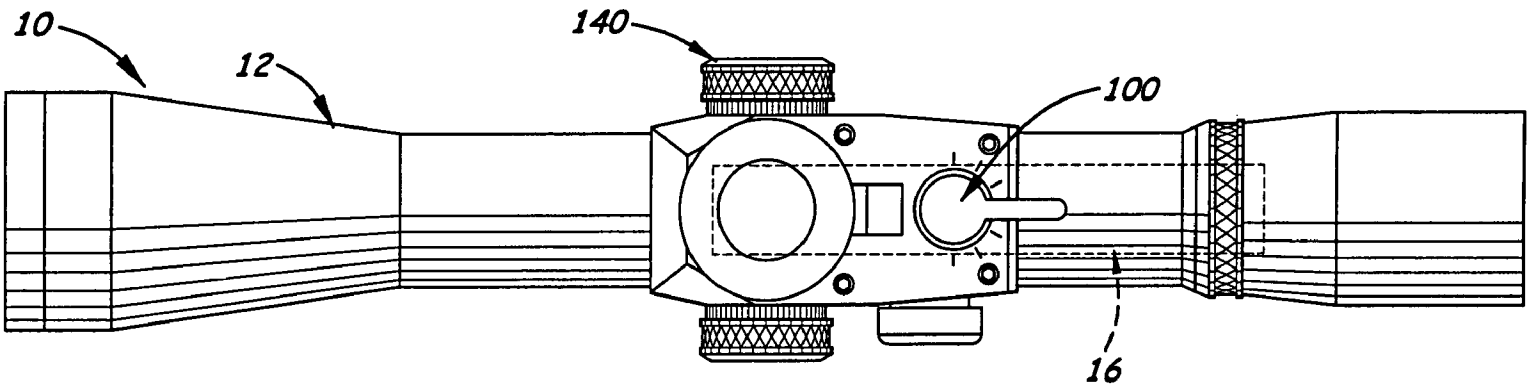
FIG. 3 is a top plan view of the riflescope shown in FIGS. 1 and 2.

Referring to the FIGS. 1-15, there is shown a riflescope high speed, coarse and fine adjustment assembly disclosed herein that includes a riflescope 10 with an elongated scope body 12 with an erector tube 16 located therein. Formed on the scope body 12 is a recessed mounting surface 18 (shown as part of a saddle) designed to receive an adjustment plate.

Disposed over the mounting surface 18 is an adjustment plate with a perpendicularly aligned rotating post member 40 disposed thereover. The post member 40 includes a threaded bore 43 designed to connect to the upper threaded head 52 of the lead screw 50.

Figure 4:
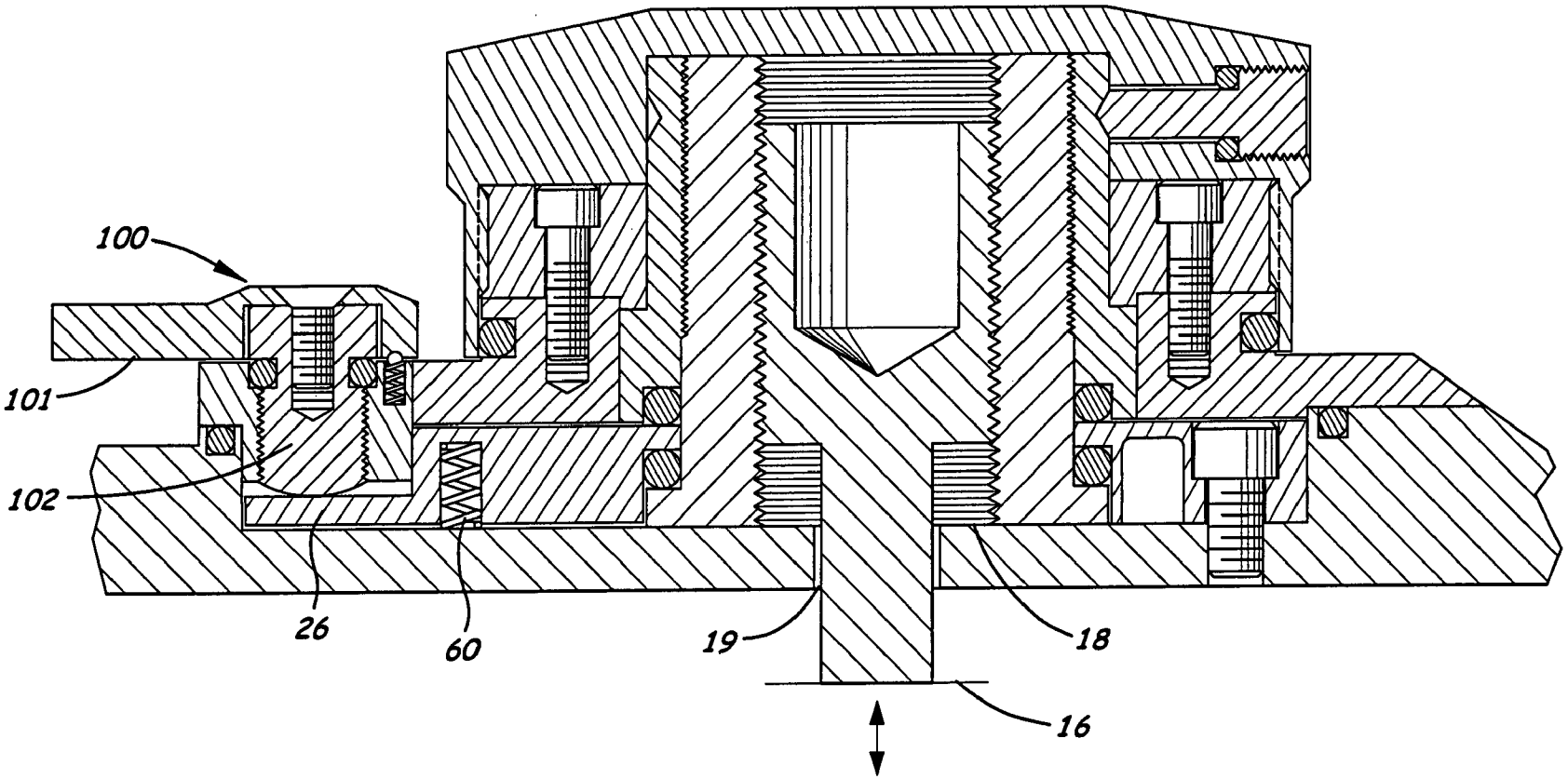
FIG. 4 is a sectional, side elevational view of the first embodiment of the high speed, adjustable elevation assembly
Figure 5:
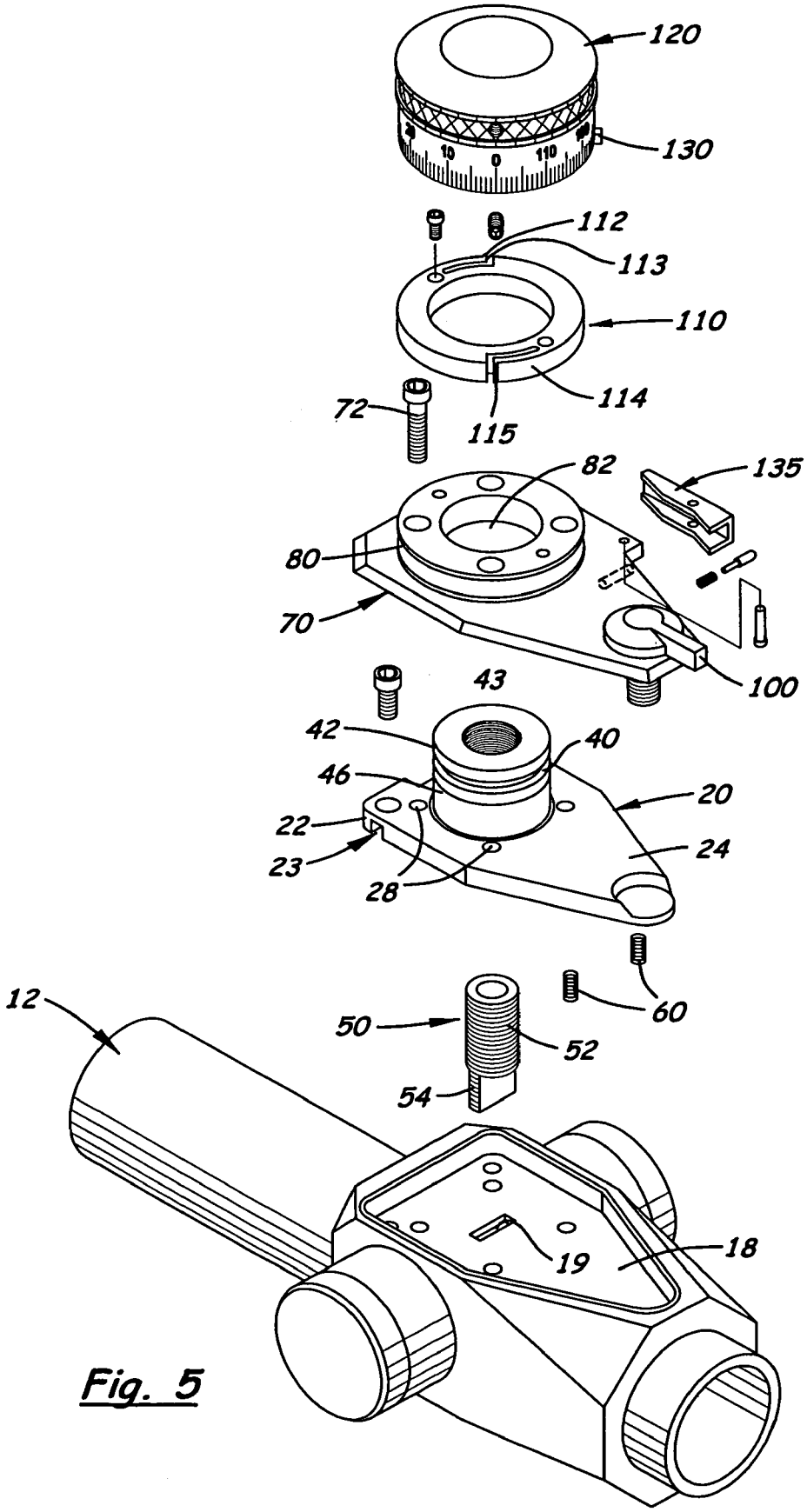
FIG. 5 is a perspective, exploded view of the high speed, adjustable elevation assembly.
Figure 6:
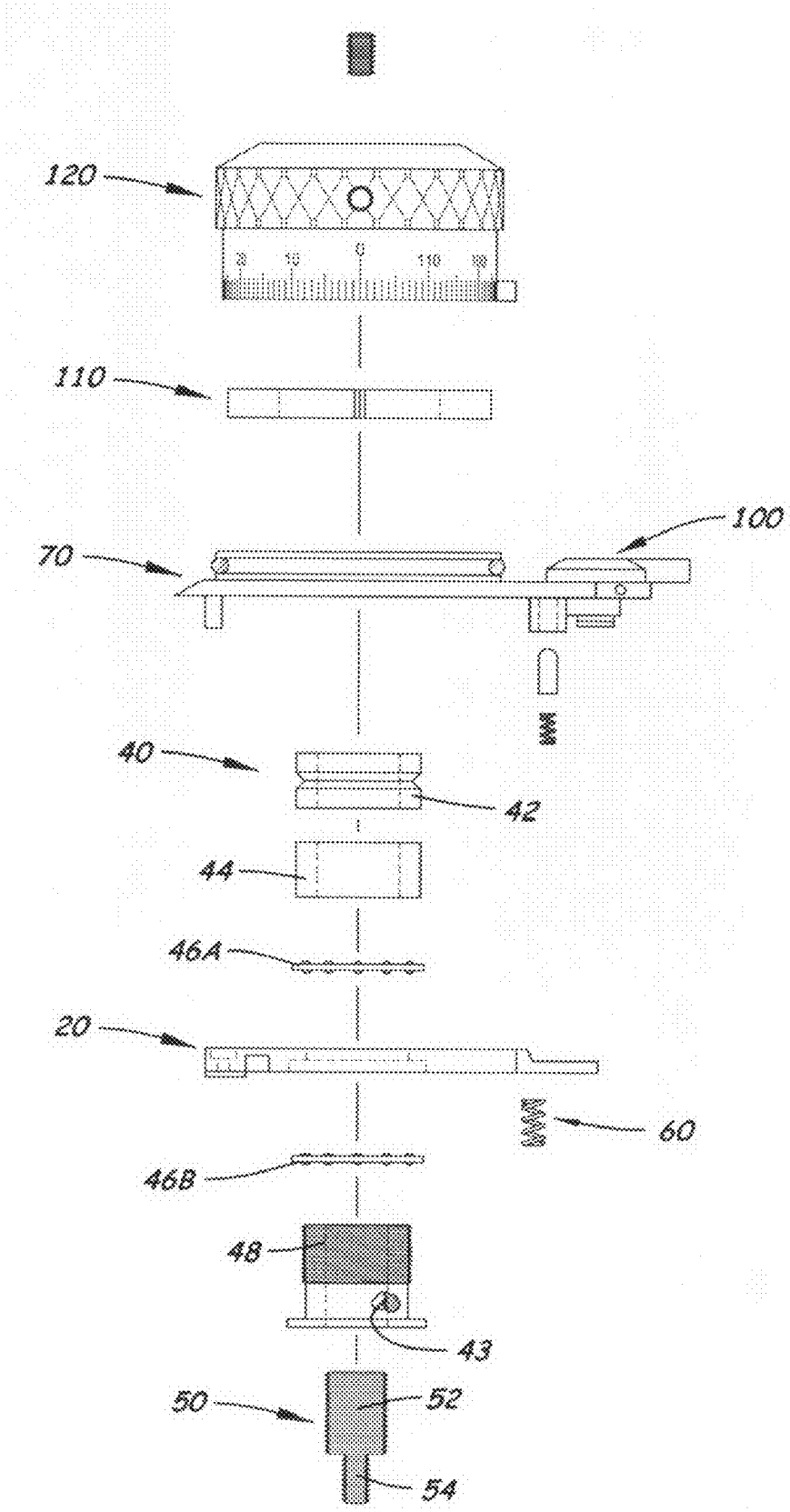
FIG. 6 is an exploded, side elevational view of the high speed, adjustable elevation assembly shown in FIGS. 4 and 5.

In the first embodiment, shown in FIGS. 4-6, the adjustment plate is a flex plate 20 affixed along its front edge to the mounting surface 18. The flex plate 20 includes a flat plate 21 with a transversely aligned groove 23 formed on its lower surface. The groove 23 enables the rear section of the flex plate 20 to bend upward when an upward force is exerted on the rear section 24 of the flex plate 20. The flex plate 20 is slightly beveled so that when the front section 22 of the flex plate 20 is attached to the mounting surface 18, the rear section 24 is slightly elevated above the mounting surface 18. One or more optional springs 60 are disposed between the rear section 24 and the mounting surface 18 to bias the rear section 24 upward.

The rotating post member 40 includes a top jam nut 42, an upper bearing support 44 and a lower bearing support 48. Located between the upper bearing support 44 and the top surface of the flex plate 20 is an upper bearing 46A. Located between the lower bearing support 48 and the bottom surface of the flex plate 20 is a second bearing 46B. Located longitudinally inside the post member 40 is a lead screw 50 with a threaded upper head 52 that connects to the internal threads 43 formed on the lower bearing support 48. The lead screw 50 includes a lower non-threaded key-shaped neck 54 that extends into a complimentary-shaped slotted bore 19 formed on the mounting surface 18. The slot 19 holds the lead screw 50 in a fixed non-rotating position on the mounting surface 18. The lead screw's neck 54 is sufficient in length to press against the proximal end of the erector tube 16 located inside the scope body 12 after assembly. When the post member 40 is rotated, the lead screw 50 advances or retracts from the slotted bore 19 which causes the proximal end of the erector tube 16 to move up and down inside the scope body 12.

Figure 7:
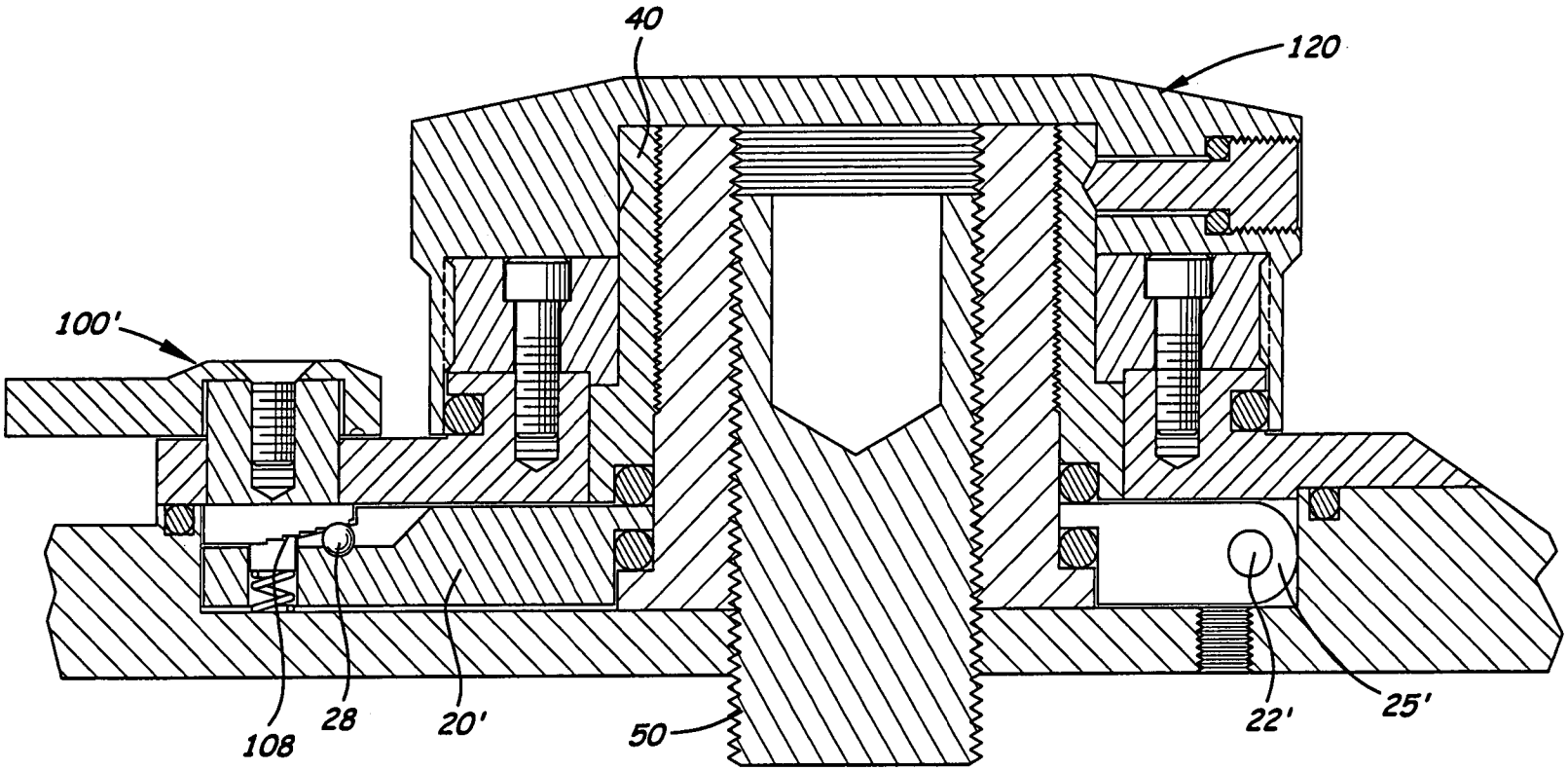
FIG. 7 is a sectional, side elevational view of a second embodiment of the high speed, adjustable elevation assembly.
Figure 8:
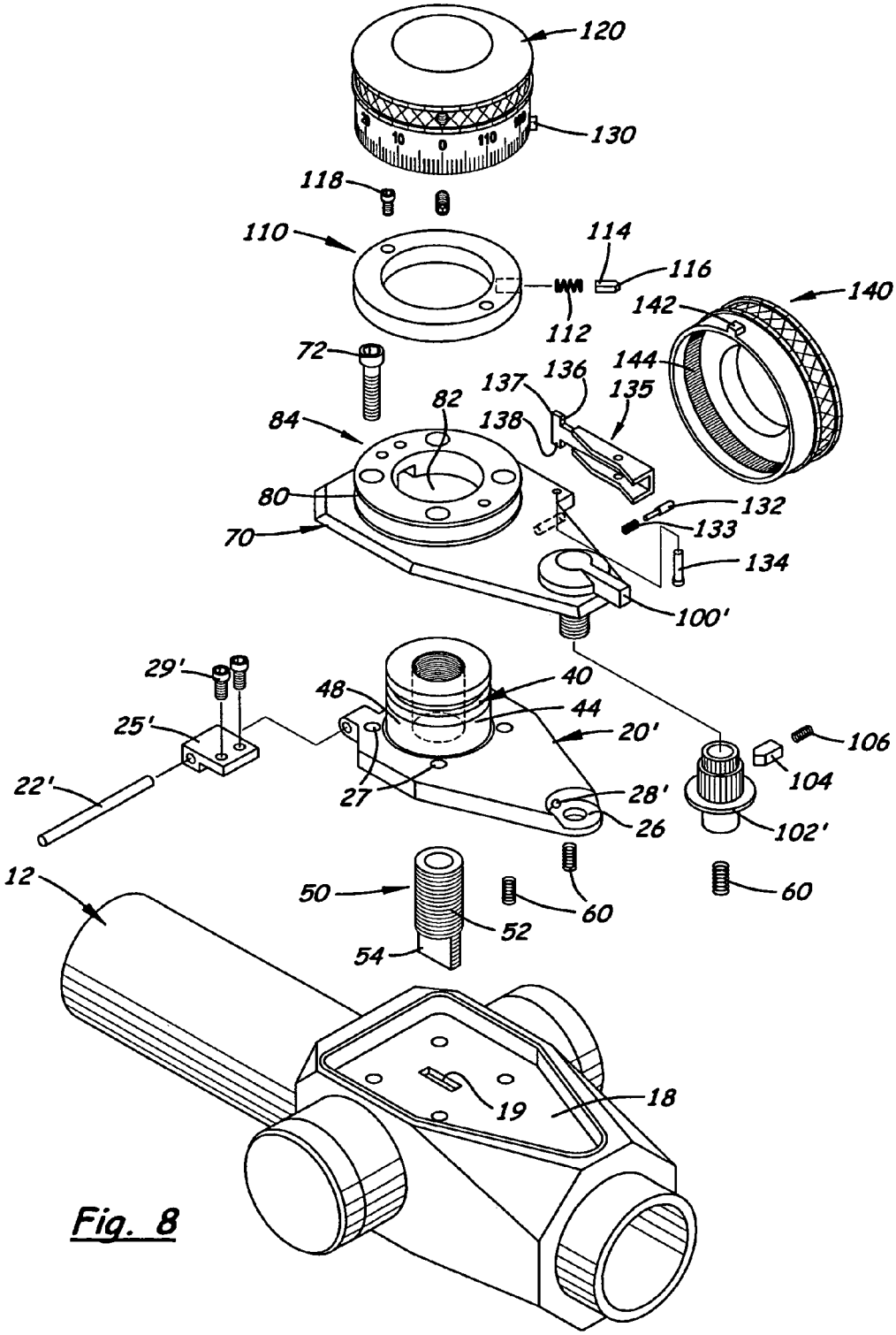
FIG. 8 is a perspective, exploded view of the high speed, adjustable elevation assembly shown in FIG. 7.
Figure 9:
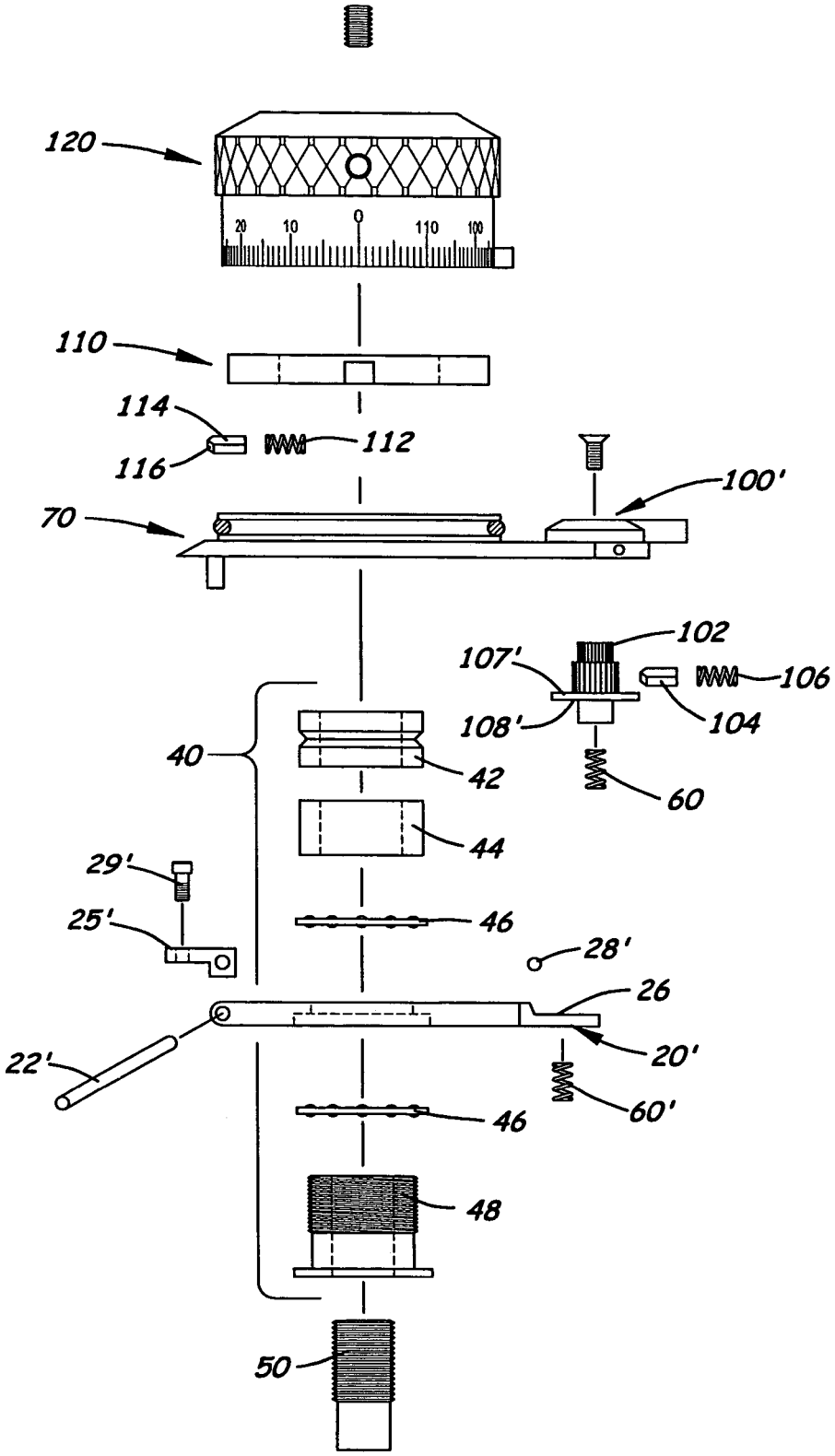
FIG. 9 is an exploded, side elevational view of the high speed, adjustable elevation assembly shown in FIGS. 7 and 8.
Figure 10:
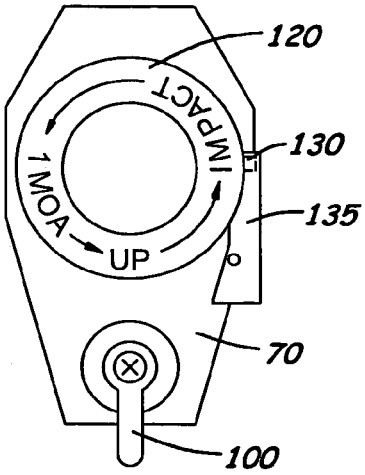
FIG. 10 is a top plan view of the elevation turn adjustment showing the quick-release tab mounted on the side of the course dial.
Figure 11:
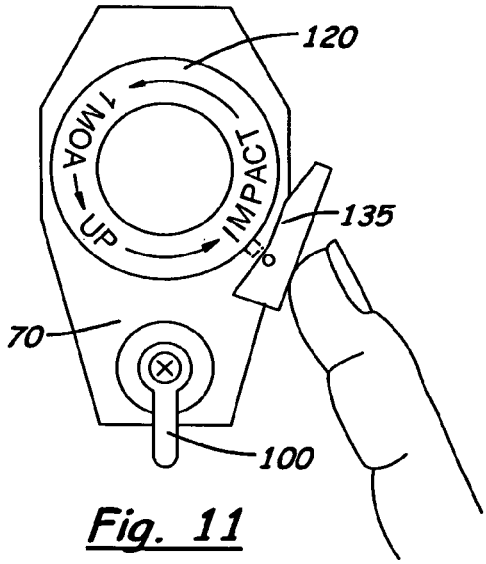
FIG. 11 is a top plan view of the elevation turn adjustment showing the release arm being pressed to release the stop tab so that the coarse dial may be rotated.
Figure 12:
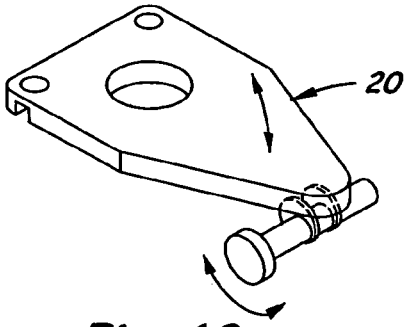
FIGS. 12-15 are illustrations of alternative structures used to raise and lower the rear portion of the hinge plate.
Figure 13:
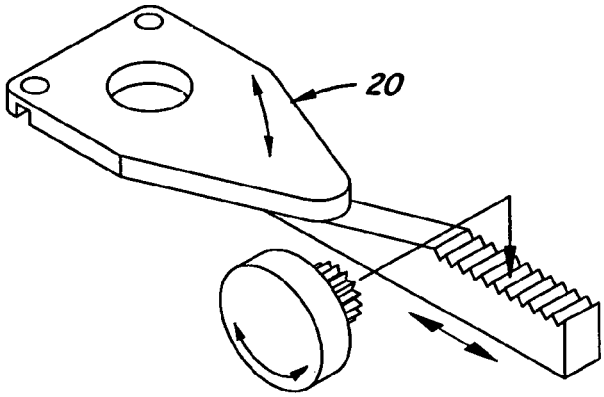
Figure 14:
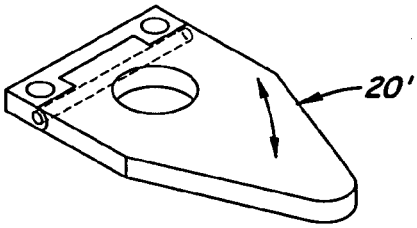
Figure 15:
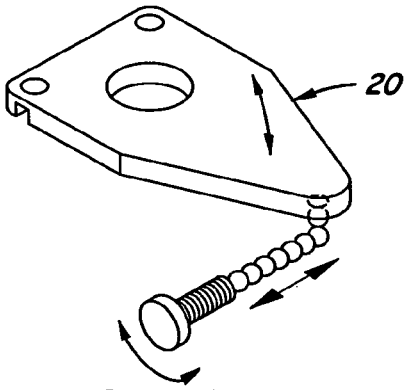

In a second embodiment, shown in FIGS. 7-9, the flex plate 20 is replaced with a hinge plate 20'. The hinge plate 20' is affixed along its front section to a transversely aligned hinge pin 22' attaching it to the hinge joint 25' located in front of the hinge plate 20'. The hinge joint 25' is securely attached to the cover plate 70 located above the hinge plate 20' with two screws 29' allowing the hinge plate 20' to "float" in the mounting surface 18 after assembly. In the preferred embodiment, the hinge plate 20' has a flat thick front section and a thinner rear section 26' allowing the mounting of the cam follower ball 28. When the front section of the hinge plate 20' is pinned to the hinge joint 25' and attached to the cover plate 70, the cam follower ball 28 rests against cam face 108 discussed further below.

One or more optional springs 60' are disposed between the rear section of the hinge plate 20' and the mounting surface 18. The springs 60' bias and help hold the rear section of the hinge plate 20' and cam follower ball 28 against the cam face 108 above the recessed surface 18.

Stacked over the flex plate 20 or the hinge plate 20' is a cover plate 70. Four threaded screws 72 are used to attach the cover plate 70 to the mounting surface 18. The screws 72 extend freely through non-threaded bores 27 formed on the flex plate 20 or hinge plate 20'. The bores 27 are slightly larger than the screws 72 and allow the flex plate 20 or hinge plate 20' to bend or pivot upward when the fine adjustment lever 100 is rotated.

In both embodiments, an O-ring seal assembly 80 is attached to the top surface of the cover plate 70. The O-ring seal assembly 80 includes a center bore 82 designed to slidingly receive the upper end of post member 40.

Attached to the rear section of the cover plate 70 is a rotating, fine adjustment lever 100. In the first embodiment shown in FIGS. 4-6, the fine adjustment lever 100 includes a handle 101 connected to a straight post 102 that advances or retracts against a recessed cavity area 26, formed on the adjustment plate. In a second embodiment shown in FIGS. 7-9, the fine adjustment lever, denoted 100' includes a handle 101' connected to a cam body 102' The cam body 102' is perpendicularly aligned and extends upward from a lower collar 107'. Formed on the lower surface of the collar 107' is a cam face 108'. During use, the fine adjustment lever 100' may be rotated in one direction to move the cam face 108' to one of its stepped positions to apply pressure to the rear section 26' of flex plate 20 (not shown) or the hinge plate 20' thereby forcing the lead screw 50 downward against the erector tube 16. The fine adjustment lever 100' may also be rotated in the opposite direction to allow the rear section 26' to move upward via the springs 60'. The lead screw 50 and the proximal end of the erector tube 16 move upward. The fine adjustment spring 106 and the backed chisel point 104 engage the vertical splines on the side of the cam body 102' to execute precise movement of cam face 108'.

Attached to the cover plate 70 is a circular detent plate 110 with one spring 112 that presses against the laterally extending chisel point 114. The chisel point 114 includes a fine tooth 116 located on its distal end. Attached over the detent plate 110 is a coarse dial 120 which includes vertically aligned splines (not shown) formed on its inside surface similar to the splines 144 shown with the windage dial 140. During operation, the chisel point 114 extends outward and engages the splines 144. In the preferred embodiment, the splines 144 are sufficient in quality and spacing so that one rotation of the coarse dial 120 equals 120 minutes.

During use, the coarse dial 120 is rotated for the desired target distance and then the fine adjustment lever 100 is rotated which causes the cam face 108 to be rotated on the cam follower ball 28 thereby pivoting the flex plate 20. The bending movement of the flex plate 20 or the pivoting movement of the hinge plate 20' finely adjusts the length of the lead screw 50 that extends into the scope body 12. The flex plate 20 or hinge plate 20' and the lead screw 50 are returned to their original positions by reversing the fine adjustment lever 100 or 100' and from the pressure exerted by the spring 60 against the mounting surface 18.

With both embodiments, a horizontally aligned lock arm 135 is pivotally attached to the cover plate 70. The lock arm 135 includes a T-shaped tongue member 136 with upward and downward extending tabs 137, 138. The lock arm 135 is pivotally mounted on the cover plate 70 with a lock pin 134. Formed on the outer surface of the course dial 120 and windage dial 140 are two tabs 130 and 142, respectively. During operation, the two stop tabs 130, 142 engage the tabs 137, 138 on the lock arm 135 to prevent rotation and lock the dials 120, 140 at their respective zero points. The lock arm 135 is pressured by a spring 133 and a plunger 132 located at the end opposite the tongue member 136. During operation, the tongue member 136 is pressed inward thereby positioning the tabs 137, 138 below the dials 120, 140. The course dial 120 or windage dial 140 are then free to move from their zero points. When the elevation dial 120 or windage dial 140 are returned to their zero points, the lock arm 135 is released so that the tabs 137, 138 may engage the stop tabs 130, 142 on either dial 120, 140, respectively, to precisely return and hold the two dials 120, 140 at their original zero points.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents

I claim:

1. A riflescope high speed, coarse and fine adjustment assembly, comprising:

a. a riflescope with a scope body having an erector tube located therein, said scope body including a mounting surface, said mounting surface including a lead screw opening formed therein located adjacent to a proximal end of an erector tube disposed inside said scope body;

b. an adjustment plate aligned over said mounting surface, said adjustment plate includes a front section and a rear section, said adjustment plate includes an upward extending, perpendicularly aligned rotating post member with a threaded bore formed therein;

c. a lead screw with a threaded head and a lower neck, said threaded head being connected to said threaded bore in said post member of said adjustment plate and said lower neck being inserted into said lead screw opening formed on said mounting surface, when said adjustment plate is positioned over said mounting surface, said lead screw being sufficient in overall length to press against the proximal end of said erector tube and threadingly connect to said post member;

d. a cover plate disposed over said adjustment plate, said cover plate includes a front section fixed to said mounting surface and detached at an opposite rear surface, said cover plate includes a fine adjustment lever attached to the rear section and able to be selectively adjusted to extend downward there and contact said adjustment plate thereby enabling a rear edge of said cover plate to be raised or lowered over said adjustment plate, said cover plate also includes an O-ring assembly;

e. a detent plate attached over said cover plate and axially aligned over said post member, said detent plate includes at least one outward extending tooth;

f. a coarse adjustment dial disposed over said detent plate, said course adjustment dial includes an inner cavity that is engaged by said tooth on said detent plate; and, g. whereby when said coarse adjustment dial is rotated said lead screw extends or retracts into said scope body and move said erector tube to view a desired target distance, said fine adjustment lever on said cover plate may be selectively rotated which causes the rear section of said adjustment plate to raise or lower with respect to said cover plate thereby finely adjusting the length of said lead screw that extends into said scope body and finely move said erector tube up and down inside said scope body.

2. A riflescope high speed, coarse and fine adjustment assembly, comprising:

a. a riflescope with a scope body having an erector tube located therein, said scope body includes a mounting surface, said mounting surface includes a lead screw opening formed therein located adjacent to a proximal end of an erector tube disposed longitudinally inside said scope body;

b. a hinge plate aligned and positioned over said mounting surface, said hinge plate includes a front section and a beveled rear section, said rear section of said hinge plate being biased upward when positioned over said mounting surface, said hinge plate includes a perpendicularly aligned post member with a threaded bore formed therein;

c. a lead screw with a threaded head and a lower neck, said threaded head being connected to said threaded bore in said post member of said hinge plate and said lower neck being inserted into said lead screw opening when said hinge plate is aligned over said mounting surface, said neck being sufficient in length to press against the proximal end of said erector tube;

d. a cover plate disposed over said hinge plate, said cover plate includes and O-ring assembly with a center bore through which said post member extends when said cover plate is aligned over said hinge plate, said cover plate includes a front edge and an opposite rear edge, said front edge being pivotally attached to said hinge plate, said cover plate includes a fine adjustment lever attached to the rear edge of said cover plate opposite the front edge of the cover plate, said fine adjustment lever being coupled to a cam collar located below said cover plate, said cam collar being beveled so that when rotated, said cover plate nears relative to said hinge plate;

e. a detent plate attached to said cover plate and axially aligned over said post member when said post member extends through said O-ring assembly on said cover plate, said detent plate includes at least one outward extending tooth;

f. a coarse adjustment dial aligned over said detent plate and said O-ring assembly, said coarse dial includes a fixing screw that locks said coarse adjustment dial onto the end of said post member that extends above said detent plate, said coarse dial engaged by said tooth on said detent plate; and, g. whereby when said coarse adjustment dial is rotated, said lower neck of said lead screw moves up or down through said lead screw opening on said mounting surface to move said erector tube to a desired coarse position, and said fine adjustment lever on said cover plate is rotated which causes the rear edge of said hinge plate to pivot upward or downward with respect to said cover plate thereby finely adjusting the length of the lower head of the lead screw that extends into said scope body.

3. A riflescope high speed, coarse and fine adjustment assembly, comprising:

a scope body having an erector tube therein and including a mounting surface, said mounting surface including a lead screw opening;

an adjustment plate positioned adjacent the mounting surface;

a post member carried by the adjustment plate with a threaded bore substantially perpendicularly aligned with the adjustment plate and substantially axially aligned with the lead screw opening;

a lead screw with a threaded portion configured to engage the threaded bore and having a portion configured to extend through the lead screw opening to the erector tube for coarse adjustment thereof when at least one of the lead screw and post member are rotated relative to the other;

said adjustment plate being configured to be positionable at differing angles relative to the mounting surface, one portion being at a fixed position relative to the mounting surface and a second portion being moveable in its position relative to the mounting surface; and a fine adjustment member configured to selectively adjust the relative position of the adjustment plate second portion and thereby change the angle of the adjustment plate relative to the mounting surface for fine adjustment of the lead screw.

4. The riflescope adjustment assembly of claim 3, wherein said one portion of the adjustment plate is hingedly mounted to the mounting surface to provide pivotal movement of the adjustment plate relative to the mounting surface.

5. The riflescope adjustment assembly of claim 3, wherein said one portion of the adjustment plate is fixed to the mounting surface such that movement of the adjustment plate relative to the mounting surface is provided by flexing of the adjustment plate.

6. The riflescope adjustment assembly of claim 3, further comprising a spring to resiliently bias the adjustment plate against movement by the fine adjustment member.

7. The riflescope adjustment assembly of claim 3, wherein the post member is rotatably mounted on the adjustment plate and the lead screw is fixed against rotation such that rotation of the post member causes relative axial movement of the lead screw.

8. The riflescope adjustment assembly of claim 7, wherein the lead screw includes a non-round portion and the lead screw opening has a complementary non-round shape to prevent rotation of the lead screw while allowing axial movement thereof.

9. The riflescope adjustment assembly of claim 3, wherein the fine adjustment member is configured such that rotation thereof adjusts the relative position of the adjustment plate.

10. The riflescope adjustment assembly of claim 9, wherein the fine adjustment member includes a threaded portion and rotation thereof causes axial travel to adjust the relative position of the adjustment plate.

11. The riflescope adjustment assembly of claim 3, wherein said fine adjustment member includes a cam surface.

12. The riflescope adjustment assembly of claim 3, wherein said fine adjustment member includes a lever.

13. The riflescope adjustment assembly of claim 3, further comprising a coarse adjustment dial for effecting relative rotational movement of the lead screw and post member and a lock arm on the scope body configured to engage a stop tab on said adjustment dial at a preselected position of adjustment.

14. The riflescope adjustment assembly of claim 13, said lock arm prevents any adjustment of said adjustment dial at the preselected position of adjustment until said lock arm is manually disengaged.

15. The riflescope adjustment assembly of claim 3, further comprising a coarse adjustment dial for effecting relative rotational movement of the lead screw and post member wherein the threaded bore and threaded portion of the lead screw are configured such that the full range of coarse adjustment is effected by a single revolution of the coarse adjustment dial.

16. The riflescope adjustment assembly of claim 3, further comprising a cover configured to mount to the scope body with the adjustment plate between the cover and the scope body.

17. The riflescope adjustment assembly of claim 16, wherein the fine adjustment member is mounted on the cover.

* * * * *